US009051751B2

(12) United States Patent
Ogilvie

(10) Patent No.: US 9,051,751 B2
(45) Date of Patent: Jun. 9, 2015

(54) PORTABLE, COLLAPSIBLE WIND SCREEN

(71) Applicant: James A. Ogilvie, Vista, CA (US)

(72) Inventor: James A. Ogilvie, Vista, CA (US)

( * ) Notice: Subject to any disclaimer, the term of this patent is extended or adjusted under 35 U.S.C. 154(b) by 0 days.

(21) Appl. No.: 13/913,418

(22) Filed: Jun. 8, 2013

(65) Prior Publication Data

US 2014/0360687 A1 Dec. 11, 2014

(51) Int. Cl.
*A47G 5/00* (2006.01)
*E04H 15/00* (2006.01)

(52) U.S. Cl.
CPC ..... *E04H 15/005* (2013.01)

(58) Field of Classification Search
CPC ..... E04H 15/003; E04H 15/005; G03B 21/58
USPC ..... 160/351, 377, 371, 372, 375, 368.1, 160/388
See application file for complete search history.

(56) References Cited

U.S. PATENT DOCUMENTS

| | | | | | |
|---|---|---|---|---|---|
| 1,073,341 | A * | 9/1913 | Gleaves | 38/102.8 |
| 1,662,586 | A * | 3/1928 | Newman | 160/351 |
| 2,357,819 | A * | 9/1944 | Greer | 160/351 |
| 3,002,557 | A * | 10/1961 | Roth et al. | 160/351 |
| 3,591,116 | A * | 7/1971 | Dalum | 248/172 |
| 4,407,319 | A * | 10/1983 | Shultz et al. | 135/87 |
| 4,685,484 | A * | 8/1987 | Moneta | 135/87 |
| 5,487,402 | A * | 1/1996 | Clary | 135/87 |
| 6,244,286 | B1 * | 6/2001 | Russo | 135/128 |
| 7,316,257 | B2 * | 1/2008 | Cameron et al. | 160/351 |
| 8,024,881 | B2 * | 9/2011 | Redmon | 40/610 |
| 8,184,213 | B2 * | 5/2012 | Yuzawa | 348/838 |
| 8,365,450 | B1 * | 2/2013 | Redmon | 40/610 |

* cited by examiner

*Primary Examiner* — Katherine Mitchell
*Assistant Examiner* — Abe Massad
(74) *Attorney, Agent, or Firm* — Steven W. Webb

(57) ABSTRACT

A portable wind screen is presented where the wind screen is composed of a collapsible metal frame with extendable legs and a fabric or plastic screen connected to said frame with Velcro® fasteners. The frame is fully collapsible and easily stored ion a bag or small box.

3 Claims, 4 Drawing Sheets

TOP CONNECTION

BOTTOM CONNECTION

PORTABLE, COLLAPSIBLE WIND SCREEN

FIELD OF THE INVENTION

The present invention relates to collapsible camping gear and party equipment.

BACKGROUND OF THE INVENTION

Outdoor activities are occasionally held in windy weather conditions, in a steady or intermittent breeze strong enough to interfere with the enjoyment of eating or ordinary conversation. Without resorting to holding activities inside an enclosed structure or tent, it is useful to be able to block said breeze with a portable means that is easy to set up and sturdy enough to withstand ordinary wind conditions.

The prior art includes several devices that act as wind screens and are reasonably portable. U.S. Pat. No. 6,244,286 to Russo teaches a portable canopy for bleacher seats, U.S. Pat. No. 4,407,319 to Shultz teaches a rigid plastic screen that is detachable into equally-sized sections, and U.S. Pat. No. 5,487,402 to Clary shows a screen of adjustable size that needs to be braced by attachment to external contacts. The present invention's features are easily distinguishable from these and other devices.

The present invention was developed to use tubular steel bracing and folding mechanisms available with portable canopies, as well as low-cost connector mechanisms, hinges and retractable pins. The invention is collapsible into a three-foot long, one-foot-in-diameter configuration that fits easily into a bag for storage and carrying.

OBJECTS OF THE INVENTION

It is an object of the invention to provide a collapsible wind screen structure that is stable under ordinary wind conditions.

It is another object of the invention that the device be light-weight and easy to assemble.

It is another object of the invention that the device be available with Velcro™ connectors with which to attach wind screens comprised of a variety of materials.

It is another object of the invention to be constructed of easy-to-obtain connectors and metal tubing.

It is another object of the invention that it be easy to set up and not require an extensive manual to master in order to use the invention.

It is another object of the invention that it be quickly and easily folded for stowage, and fit into a cylindrically-shaped bag when collapsed.

SUMMARY OF THE INVENTION

The present invention is a single structure frame comprised of metal tubing, hinges, retractable pin connectors, and Velcro™ fasteners, said structure supporting a cloth or plastic wind screen attached via said fasteners The wind screen is comprised of a tough fabric or plastic sheeting impermeable to wind. These fabrics include acrylic, polyester, nylon, and other outdoor-use fabrics.

When assembled, the frame is supported by folding legs that snap down and support the frame in a vertical position. The legs can be braced with sandbags or other weights in high-wind situations.

The metal tubing is configured such that the long vertical members are comprised of two separate pieces of tubing that slide into each other, held in the open position by retractable pins. The long horizontal members are hinged in the middle and are held in the open position by retractable pins.

The set up of the invention is comprised of approximately a dozen simple moves to open, unfold, or slide open pieces of metal tubing and snap then into the full open position with the retractable pins. Storage is the reverse, and the length of the individual members is designed to enable the entire structure to be held in a bag.

DETAILED DESCRIPTION

Figure 1:
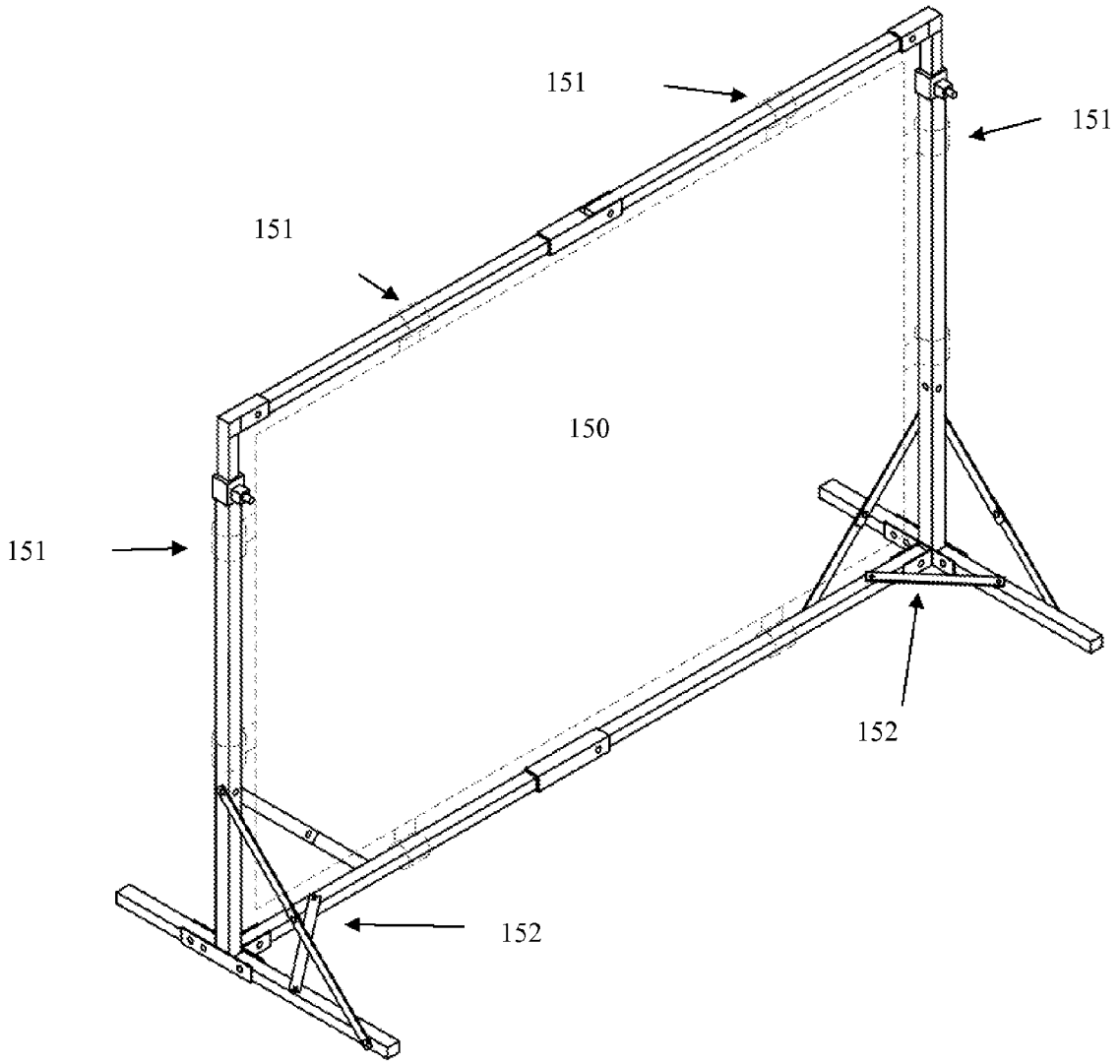
FIG. 1. Overview diagram of invention assembled
FIG. 2. Invention frame
FIG. 3. Invention frame partially collapsed
FIG. 4. Side view of invention leg assembly
FIG. 5. Invention leg assembly partially collapsed
FIG. 6. Close up of invention leg assembly
FIG. 7. Close-up of spring-loaded bolt
FIG. 8. Side view of spring-loaded bolt
FIG. 9. Top-down view of junction between vertical and horizontal bar
FIG. 10. Bottom-up view of junction of legs and bottom horizontal bar
FIG. 11. Collapsed invention

The invention 100 as shown in FIG. 1 is a wind screen comprised of a fabric or plastic screen 150 and a frame, the screen 150 held to the frame with a plurality of Velcro® connectors 151, constructed from a set of tubular metal sections that are connected together with hinges and retractable pins. The frame is supported at the bottom by two retractable legs on each side of the frame, braced by a horizontal brace 152, which legs can be weighted for stability.

Figure 2:
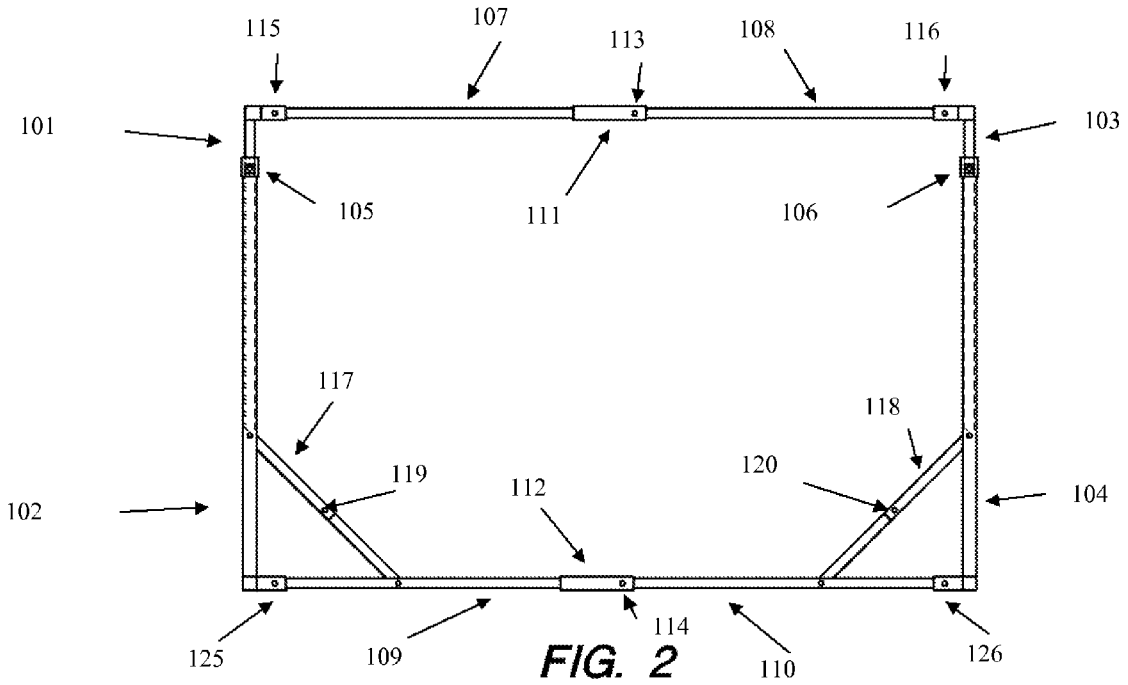
Figure 3:
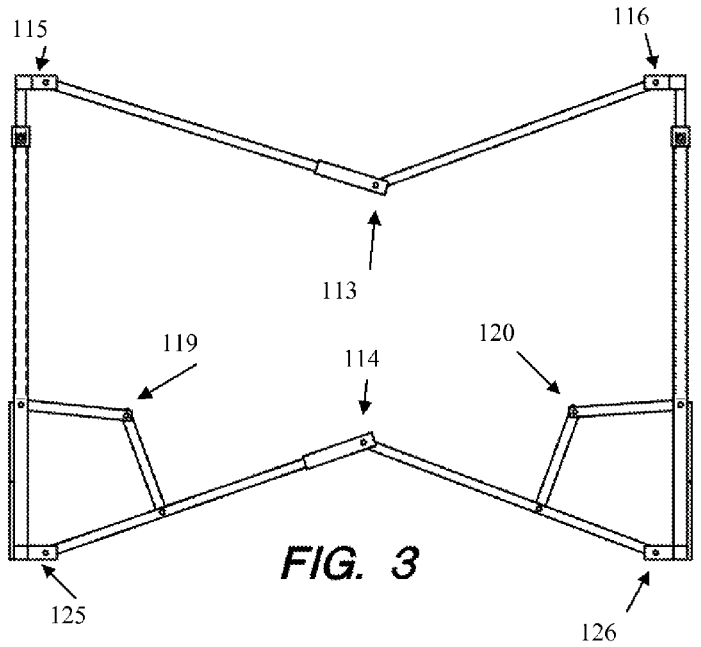

In FIG. 2 and FIG. 3, the vertical sections 101,102 and 103,104 slide into each other for storage, and when pulled out to their maximum length are held at that position by retractable pins 105,106.

The horizontal sections 107,108 and 109,110 are hinged in the middle for storage and are held in their extended positions by retractable pins 113,114 placed near the hinges 111,112. Hinges 115,116 and 125,126 at the juncture of the horizontal sections and vertical sections of the frame allow the horizontal sections to fold against the vertical sections. At no time does the assembly come apart, but the entire apparatus remains connected by hinges.

In FIGS. 2 and 3, at the bottom corners of the invention where the hinged vertical and horizontal sections come together are two bracing members 117,118 which are hinged in the middle and snap together with their own retractable pins 119,120.

Figure 4:
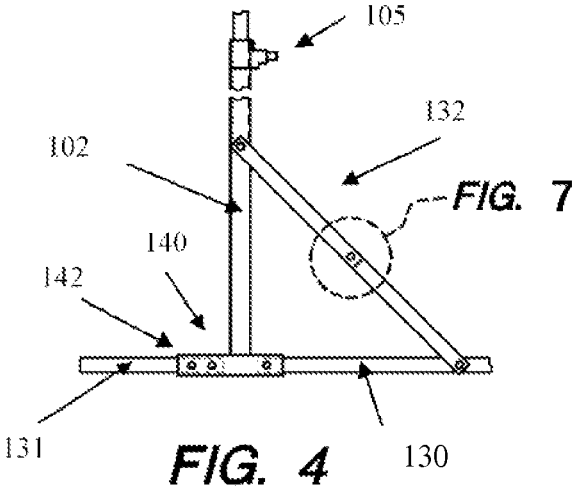
Figure 5:
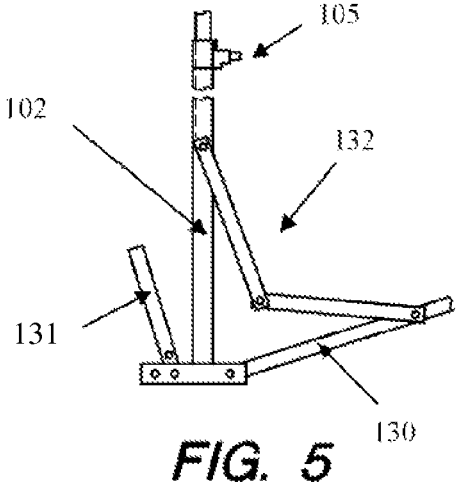
Figure 6:
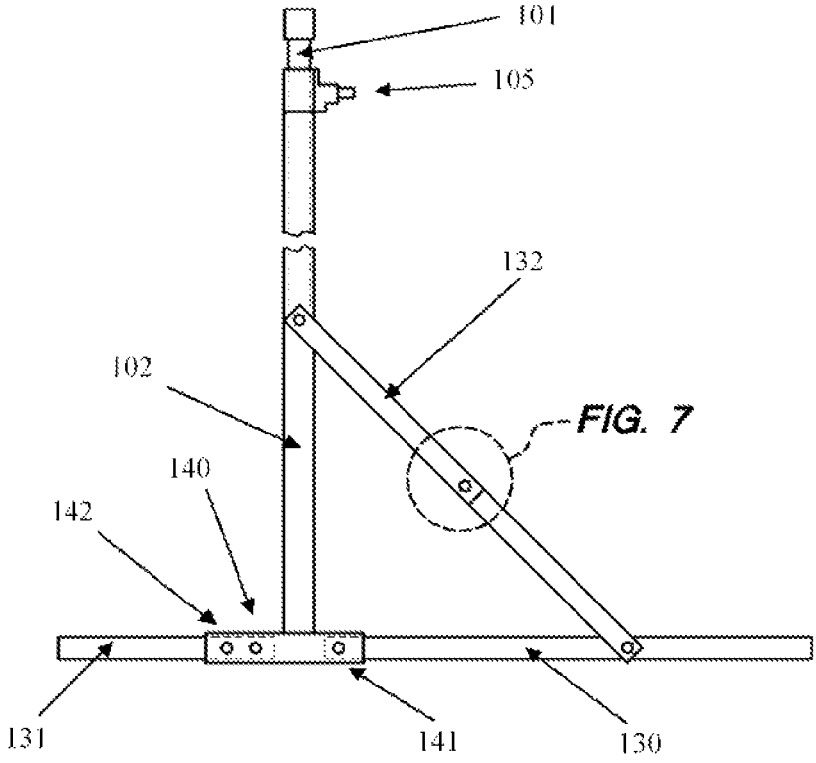
Figure 7:
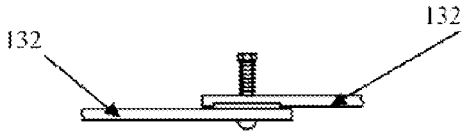
Figure 8:
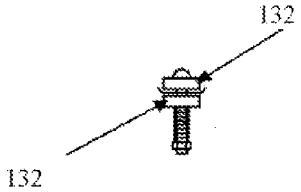
Figure 9:
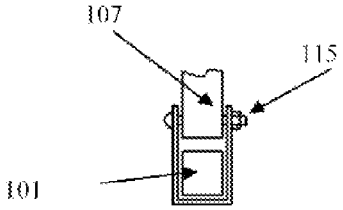
Figure 10:
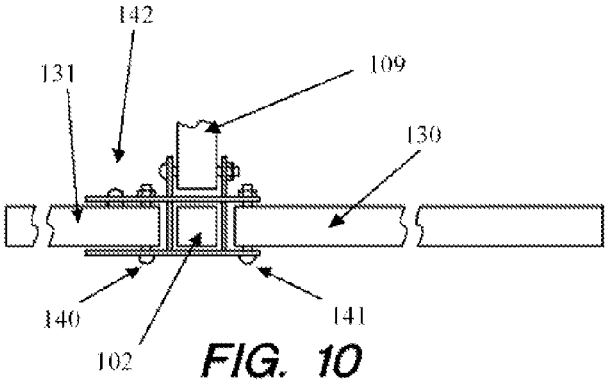
Figure 11:
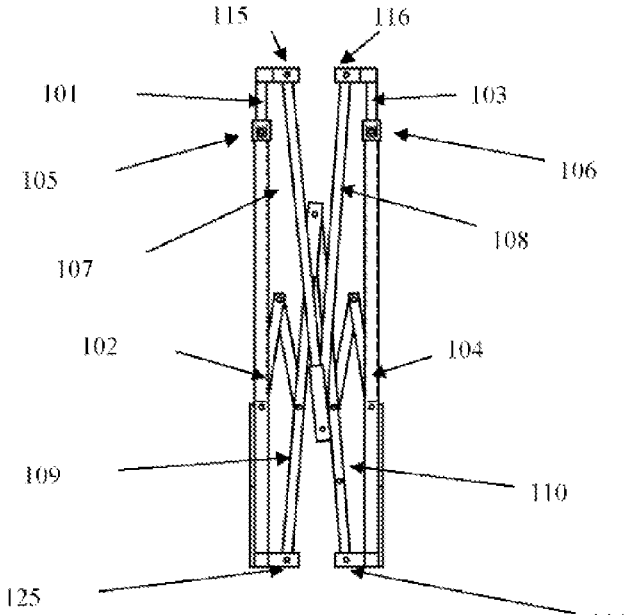

In FIG. 4. the inventions legs 131,130 are shown, which fold up against each of the lower vertical sections 118,120 as in FIG. 5. The top-down view of FIG. 9 shows where the vertical section 101 meets the upper horizontal section 107, hinged by hinge 115. In FIG. 10, a bottom-up view of the junction of the frame vertical member 102 and bottom horizontal member 109 with the legs, the longer leg 130 and the shorter leg 131 deploying from the junction, rotating around hinges 140 and 141, one pair on each side of the frame bottom. The legs are held in their extended positions by retractable pin 142 and bracing member 132 as in FIG. 7.

As designed, the longer and shorter leg can be further braced by placing a weight, such as a sandbag, on each of them after they are snapped into position.

The invention is designed to be covered by a cloth or plastic screen 150, attached at the top, bottom, and sides by means of a plurality of hook and loop fasteners 151. By placing the invention at the correct orientation against the wind, the invention will stop the movement of air behind the invention screen and remain stable and upright.

In the preferred embodiment, the screen is cloth, the metal comprising the tubular frame is light-gauge steel, and the folded-up length of the screen is between 2½ and 3 feet.

Although the invention has been described as a preferred embodiment, equivalent features may be employed and substitutions made within this specification without departing from the scope of the invention as recited in the claims.

What is claimed is:

1. A collapsible wind screen, the wind screen comprised of a collapsible frame and a screen, the collapsible frame comprised of a plurality of tubular metal components connected with hinges and held in place with a plurality of retractible pin fasteners, said tubular metal components comprised of a left extendable segment and a right extendable segment, the two extendable segments placed vertically, each extendable segment comprised of an outer segment and an inner segment, said inner segment fitting slideably inside the length of the outer segment, the inner segment held in place when pulled out of the outer segment by a retractible pin fastener, the two extendable segments connected to each other at the top by a top horizontal segment and at the bottom by a bottom horizontal segment, the top horizontal segment comprised of a left and right top segment, the left top segment connected to the left extendable segment by means of an offset hinge, the right top segment connected to the right extendable segment by means of an offset hinge, the left and right top segments connected rotatably to each other at the middle of the top horizontal segment by means of a hinge and a retractible pin fastener, the bottom horizontal segment comprised of a left and right bottom segment, the left bottom segment connected rotatably to the left extendable segment by means of an offset hinge, the right bottom segment connected rotatably to the right extendable segment by means of an offset hinge, the left and right bottom segments connected rotatably to each other at the middle of the bottom horizontal segment by means of a hinge and a retractible pin fastener, wherein when the frame is in an extended configuration the wind screen defines a plane; and when the frame is moved to a collapsed configuration, the right top segment and the right bottom segment are folded toward the right extendable segment substantially along the plane; and the left top segment and the left bottom segment are folded toward the left extendable segment substantially along the plane;

the tubular metal components further comprised of a left short leg, a left long leg, a right short leg, and a right long leg, the left short leg connected rotatably to the bottom end of the left extendable segment at a right angle to the bottom horizontal segment by means of a hinge and held in an extended position by means of a retractible pin fastener, the left long leg connected to the bottom end of the left extendable segment at the other right angle to the bottom horizontal segment by means of a hinge and held in an extended position by means of a vertical bracing member, the right short leg connected rotatably to the bottom end of the right extendable segment at a right angle to the bottom horizontal segment by means of a hinge and held in an extended position by means of a retractible pin fastener, the right long leg connected rotatably to the bottom end of the right extendable segment at the other right angle to the bottom horizontal segment by means of a hinge and held in an extended position by means of a vertical bracing member, the left long leg and the right long leg each connected fixedly to the bottom horizontal segment by means of a horizontal bracing member, the collapsible frame capable of standing upright on the plurality of short and long legs when they are fully extended and braced, the collapsible frame extendable by means of pulling out and adjusting the left and right extendable segments and securing them by means of the retractible pins as well as unfolding the top and bottom horizontal segments and fixing them in place by means of their retractible pin fasteners, the fully extended frame connected to the screen by means of hook and loop fasteners attached to the top and bottom horizontal segments and the left and right extendable segments.

2. The collapsible wind screen of claim 1, where the screen is comprised of a material selected from the list of fabric or plastic.

3. The collapsible wind screen of claim 1 where the tubular metal components are comprised of tubular steel with a rectangular cross section.

* * * * *